US007942004B2

(12) United States Patent
Hodder

(10) Patent No.: US 7,942,004 B2
(45) Date of Patent: May 17, 2011

(54) TILE AND EXO-SKELETON TILE STRUCTURE

(75) Inventor: David Hodder, Enderby (GB)

(73) Assignee: Alstom Technology Ltd, Baden (CH)

( * ) Notice: Subject to any disclaimer, the term of this patent is extended or adjusted under 35 U.S.C. 154(b) by 1061 days.

(21) Appl. No.: 11/290,998

(22) Filed: Nov. 30, 2005

(65) Prior Publication Data

US 2006/0179770 A1 Aug. 17, 2006

(30) Foreign Application Priority Data

Nov. 30, 2004 (GB) ..... 0426235.8

(51) Int. Cl.
*F02C 1/00* (2006.01)

(52) U.S. Cl. ..... 60/752; 60/39.32; 52/582.1; 52/509

(58) Field of Classification Search ..... 52/582.1, 52/582.2, 509; 60/39.32, 752, 753, 754
See application file for complete search history.

(56) References Cited

U.S. PATENT DOCUMENTS

| | | | | | |
|---|---|---|---|---|---|
| 2,544,538 | A | * | 3/1951 | Mahnken et al. | 138/113 |
| 2,918,793 | A | * | 12/1959 | Jerie et al. | 60/755 |
| 3,965,066 | A | * | 6/1976 | Sterman et al. | 60/800 |
| 4,158,949 | A | * | 6/1979 | Reider | 60/800 |
| 4,302,932 | A | * | 12/1981 | Kuznetsov et al. | 60/800 |
| 4,378,961 | A | * | 4/1983 | Trousdell | 415/137 |
| 4,614,082 | A | * | 9/1986 | Sterman et al. | 60/796 |
| 4,861,229 | A | * | 8/1989 | Halstead | 415/138 |
| 5,025,622 | A | * | 6/1991 | Melconian | 60/39.464 |
| 5,079,915 | A | | 1/1992 | Veau | |
| 5,144,795 | A | * | 9/1992 | Field | 60/226.1 |
| 5,363,643 | A | * | 11/1994 | Halila | 60/796 |
| 5,461,866 | A | * | 10/1995 | Sullivan et al. | 60/757 |
| 5,499,499 | A | * | 3/1996 | Ambrogi et al. | |
| 5,560,198 | A | * | 10/1996 | Brewer et al. | 60/766 |
| 5,598,697 | A | | 2/1997 | Ambrogi et al. | |
| 5,799,491 | A | * | 9/1998 | Bell et al. | 60/752 |
| 6,079,199 | A | * | 6/2000 | McCaldon et al. | 60/800 |
| 6,098,397 | A | * | 8/2000 | Glezer et al. | |
| 6,155,055 | A | * | 12/2000 | Forestier | 60/747 |
| 6,347,508 | B1 | * | 2/2002 | Smallwood et al. | 60/796 |
| 6,658,853 | B2 | * | 12/2003 | Matsuda et al. | 60/753 |
| 6,807,803 | B2 | * | 10/2004 | Poccia et al. | 60/39.5 |
| 6,854,738 | B2 | * | 2/2005 | Matsuda et al. | 277/632 |
| 6,931,855 | B2 | * | 8/2005 | Glessner et al. | 60/772 |
| 6,962,025 | B1 | * | 11/2005 | Hill | 52/396.04 |

FOREIGN PATENT DOCUMENTS

| | | | |
|---|---|---|---|
| DE | 43 09 200 | A1 * | 9/1994 |
| EP | 0 647 817 | A1 * | 4/1995 |
| WO | WO 99/64791 | * | 12/1999 |

* cited by examiner

*Primary Examiner* — Eileen Lillis
*Assistant Examiner* — James Ference
(74) *Attorney, Agent, or Firm* — Kirschstein, et al.

(57) ABSTRACT

It is known to assist cooling of a combustion chamber in a gas turbine by fixing an exo-skeleton tile structure to an inner annular combustion liner shell. To improve structural integrity of the exo-skeleton tile structure, each tile is formed with at least one rib extending circumferentially across the outer surface of the tile. An end of each rib projects beyond one edge of the tile, like tiles being linked at overlapping edges by the inter-engagement of a projecting rib of one tile with the rib of an adjacent tile. The inter-engaging ends of the ribs are relatively slideable circumferentially to allow thermal expansion and contraction of the exo-skeleton structure, but sockets are provided where the ribs engage so as to resist relative bending of the adjacent tiles about their linked edges and impart rigidity to the structure.

19 Claims, 3 Drawing Sheets

TILE AND EXO-SKELETON TILE STRUCTURE

FIELD OF THE INVENTION

The present invention relates to a generally part-annular tile and to an exo-skeleton tile structure, suitable for an annular combustion liner shell to facilitate cooling of the liner shell by axial gas flow along the gap therebetween. It is particularly useful in gas turbines whose combustion chambers have inner and outer liner shells each requiring cooling.

BACKGROUND OF THE INVENTION

As shown in FIGS. 1 and 3, an existing Alstom gas turbine, the GT13E2, comprises an engine 10 receiving compressor gas into its plenum 11 in the direction 12. This gas is fed through a burner system 13 and into a combustion chamber 14 at lower pressure than the plenum 11, where it is combined with fuel and ignited. The lower pressure in the combustion chamber 14 means that the liner shell, comprising an inner liner shell 15 and an outer liner shell 17, both generally annular, have to withstand the differential pressures. In addition to the requirement to resist external pressure, the liner shells need to withstand high internal temperatures up to 500° C. or higher, and need to provide sufficient resistance to thermally-induced and pressure-induced stresses, creep and buckling failure modes which would otherwise result in an unacceptable component life. The shells need to be sufficiently rigid during operation and resistant to flexing during handling, to avoid damage to themselves and to any coatings applied to them. Cooling of the liner shells is usually provided in the form of impingement and/or convection cooling from the cold side of the shell wall. Channels or an annular cooling flow space are provided by an external structure, in the form of an exo-skeleton tile structure. A tile structure 16 of generally annular shape covers the inner liner shell 15, and correspondingly a similar tile structure 18 covers the outer liner shell 17.

As shown in FIG. 3*a*, which is a perspective view of parts of two adjacent tiles 18, linked edgewise parallel to the axial direction 25 of the engine, impingement flows 21 are caused by a multiplicity of apertures 32 through the tiles. Further, there are convection flows 31 along the annular gap between the cold side 19 of the liner shell and the exo-skeleton tile structure 18. The hot side of the liner shell 20 is heated by the combustion within the combustion chamber 14. The tiles 18 each have an edge strip 30 at a different radius from the remainder of the tile 18*a*, FIG. 3*c*, which accommodates the opposite edge of an adjacent tile 18*b*. The radial difference is the same as the thickness of the tile. This allows the adjacent tiles 18*a*, 18*b* to present a generally annular surface, even though they overlap. Retention tabs 28 are provided periodically along the edge to cover the edge strip 30, so as to retain the opposite edge of the adjacent tile 18*b* whilst allowing for circumferential expansion 29.

As shown in FIG. 3*b*, U clips 26, welded onto the hot side 20 of the liner shell 17, have integral studs which project through apertures 22 in the tiles 18. Nuts and Bellville washers 27 secure the studs in place, and locate the exo-skeleton tile structure over the liner shell 17.

This exo-skeleton tile structure resists bending in the axial and shear directions but has the disadvantage of having a low resistance to bending about the axially-extending edges of the adjacent tiles.

FIG. 2 is a series of graphs showing the temperature gradient and the thermal stresses resulting from a given constant thermal loading applied to liner shells of different wall thicknesses. The thermal stress is applied to a skin with a 1 mm TBC (Thermal Barrier Coating) on a high temperature turbine component which has active cooling. The coating is a ceramic type coating commonly containing Yttrium with a bond coat system. TBC provides the surface with additional temperature capability, acts as a reflector of radiation to reduce the overall heat flux and provides a small degree of insulation. There is convective cooling using a 1 mm rib height: a rib is provided on the cold side of the hot liner shell and acts as a turbulator to enhance the cooling convective heat transfer coefficient. Delta temperature, i.e. the difference in temperature across the skin, increases, as expected with wall thickness. Thermal stress also increases substantially with wall thickness. From this, it can be seen that there has to be a trade-off between component life, with respect to thermal stresses, on the one hand, and resistance to pressure buckling, on the other hand. A thin liner shell is preferred, for resisting thermal gradient stresses. However, resistance to buckling failure modes, particularly for the outer liner shell, is compromised by such thinner walls.

This explains the need for structural support external to the liner shell. The problem with the existing exo-skeleton tile structure with regard to this support is that, whilst it is capable of expansion in the circumferential direction, to accommodate changes in use, it offers little or no rigidity to bending in this circumferential direction.

Further, it is necessary to consider vibration modes in the gas turbine in use, and the existing configuration of exo-skeleton tile structure offers little opportunity for the tuning out of problematic resonances in the combined structure.

Accordingly, the purpose of the invention is to mitigate the disadvantages and limitations of the existing exo-skeleton tile structure.

SUMMARY OF THE INVENTION

The present invention accordingly provides a generally part-annular tile with means for connection, in use, to a parallel annular liner shell, such as a gas turbine combustion liner shell, and formed with at least one rib extending circumferentially across the outer surface of the tile and projecting beyond one edge of the tile, such that like tiles may be linked at their edges by the inter-engagement of a projecting rib of one tile with the rib of an adjacent tile, to form a complete, generally annular structure in use, the inter-engagement being such that the ribs of adjacent tiles are relatively slideable circumferentially, to allow thermal expansion and contraction of the annular structure in use, but such as to resist relative bending of the adjacent tiles about their linked edges, to impart rigidity to the structure.

Preferably, the tile has a multiplicity of apertures to allow coolant gas to flow through the tile into the gap between the tile and the liner shell, and to impinge on the external surface of the liner shell. It is also preferred that the tile has a strip of different radius at one of its edges, so that the opposite edge of an adjacent like tile can overlap that strip to allow the tiles to present a generally continuous annular surface.

The at least one rib that extends circumferentially across the outer surface of the tile and projects beyond one edge of the tile, may have at the opposite end a socket for slidingly receiving the projecting rib of an adjacent like tile to form said inter-engagement, the socket providing a radial reaction force for preventing relative bending of the tiles. This socket may comprise a further, parallel rib to one side of the end of the main rib, and a socket top cover bridging the parallel ribs.

With regard to its comparative dimensions, the socket may extend circumferentially over between ⅕ and ½ of the width of the tile, preferably between ¼ and ⅓ of the width of the tile.

Conveniently, the rib is of rectangular section with one edge connected to the tile, the rib projecting radially from the tile normal to its surface. To enhance the stiffness of the tile, there are preferably at least two parallel circumferential ribs; there may also be at least one axially-extending stiffening rib crossing the said circumferential rib or ribs.

The connection means between the tile and the liner shell may comprise apertures through the tiles for cooperating with studs projecting radially from the liner shell.

With regard to materials, and assuming use in a gas turbine combustor system, the tile should be formed of high strength weldable metal alloy capable of withstanding 500° C., for example, an indium cobalt alloy such as Inco 617 (Trade Mark). The rib or ribs is or are connected to the tile by brazing or TIG-type welding to transmit shear loading.

To assist assembly of each tile into a structure of which it forms a part, it may comprise means for temporarily fixing together a rib of one tile with the socket of an adjacent tile against circumferential sliding movement, the rib and socket of each tile being formed to receive the fixing means. The fixing means may comprise pins, and in this case the ribs are formed to accommodate pins extending axially of the tile.

Regarding relative dimensions of the tile, it may have an angular extent around the circumference of the liner shell of from 5 degrees to 15 degrees, preferably 10 degrees to 15 degrees.

Further the invention provides a generally annular exo-skeleton tile structure for an annular liner shell to facilitate cooling of the liner shell by axial gas flow along the gap therebetween, comprising part-annular tiles, the tiles being linked together edgewise by the inter-engagement of external circumferentially-extending ribs on the outer surfaces of the tiles, the inter-engagement being such that the ribs of adjacent tiles are relatively slideable circumferentially, to allow thermal expansion and contraction of the annular structure in use, but such as to resist relative bending of the adjacent tiles about their linked edges, to impart rigidity to the structure; the tiles having means for connection to the underlying liner shell in use.

Further, the invention provides a gas turbine structure comprising a combustion chamber whose liner shell has an exo-skeleton tile structure.

Further still, the invention provides a method of forming a generally annular exo-skeleton tile structure over an annular liner shell, comprising connecting a plurality of part-annular tiles to the liner shell with their edges linked together and their ribs inter-engaging to prevent bending along the edges. As previously mentioned, assembly can be aided by pinning the ribs of adjacent tiles together during assembly, the pins being removed after assembly. The above-mentioned socket top cover can be connected after the ribs have been inter-engaged.

Wear coatings, such as Stellite 6 (Trade Mark), can be applied to the tiles, or to the liner shells, or both, including the ribs.

The rib in each tile, capable of inter-engaging the rib of an adjacent tile, provides circumferential stiffening and overcomes the previous problem of bending in the circumferential direction.

A further advantage of the invention is that the tuning of resonant vibration modes becomes possible by optimizing the number and location of the stiffening ribs.

Damping of vibrational modes is facilitated by friction inherent in the sliding joints between inter-engaging ribs.

Further features of the invention will be apparent from a perusal of the following description and the appended claims.

BRIEF DESCRIPTION OF THE DRAWINGS

In order that the invention may be better understood, a preferred embodiment of the invention will now be described, by way of example only, with reference to the accompanying drawings, in which:

FIG. 3*b* being a section taken along the line BB of FIG. 3*a* and showing an interconnection between the liner shell and the tile; and FIG. 3*c* being a section taken along AA of FIG. 3*a*, across the inter-engaging edges of two adjacent tiles;

DETAILED DESCRIPTION OF THE PREFERRED EMBODIMENTS

Figure 4:
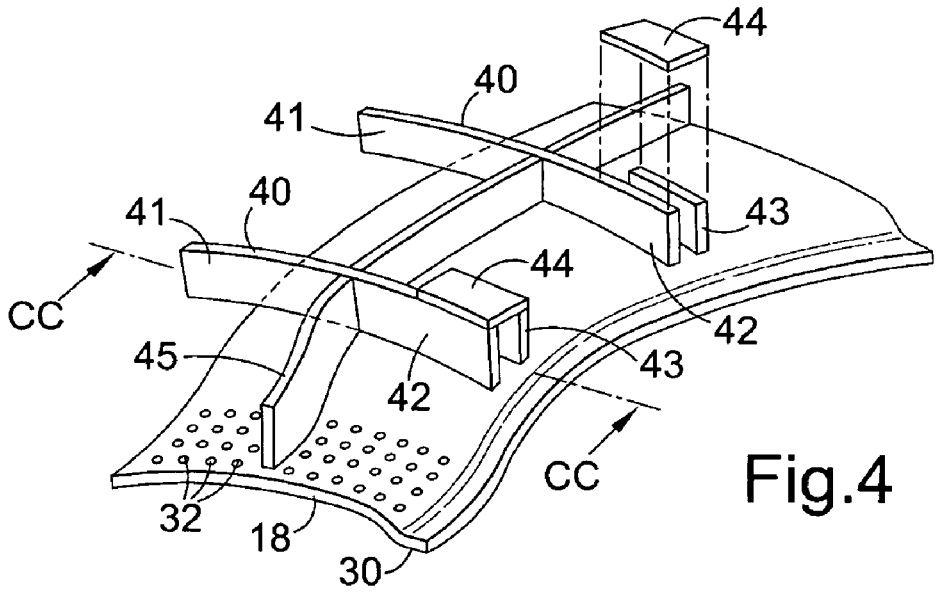
FIG. 4 is a perspective view of one tile embodying the invention.
Figure 5:
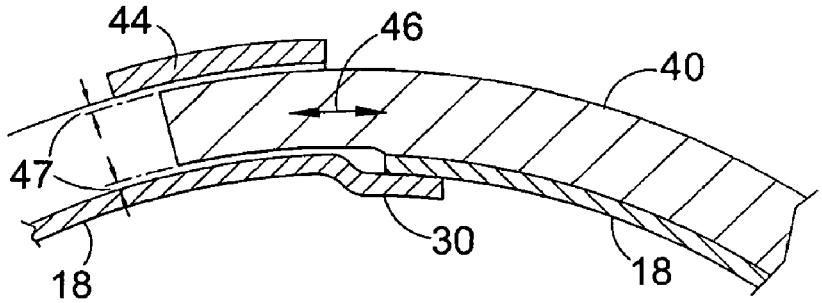
FIG. 5 is a section CC through the tile of FIG. 4, showing a sliding joint arrangement between adjacent tiles.

As shown in FIGS. 4 and 5, the tile 18, formed of Inco 617 (Trade Mark) alloy, and resistant to at least 500° C., has two strengthening ribs 40 extending circumferentially, and at least one rib 45 extending axially, the ribs being fastened to the tile surface by brazing or TIG type welding, so as to be capable of transmitting shear loading. In this example, there are two parallel circumferential ribs 40, and one axial stiffening rib 45 which crosses the circumferential ribs 40, but it will be apparent that the number of each type of rib is selectable; in some applications there may be no axial stiffening ribs 45 and there may be one or else three or more circumferential ribs 40.

Each rib has a rectangular section (although other sections could instead be selected—say circular) and extends normally from the cold surface of the tile 18. The tile presents a generally annular surface, whose radius varies along the axis, i.e. the diameter of the exo-skeleton tile structure varies along the length of the engine. The tile 18 subtends, in this example, an angle of approximately 15° in the circumferential direction, and the complete structure would therefore require 24 inter-engaging tiles joined edgewise. In other examples, the range of angles for each tile could be between say 5° and 15°, preferably 10° to 15°; segments subtending much more than 15° would begin to develop significant Meridional stress issues.

Each circumferential rib 40 has at one end a projecting portion 41 beyond the edge of the tile. This engages in a socket 42 formed by the opposite end of the rib 40 of an adjacent tile. The socket is formed by one end 41 of the rib 40, by a parallel and adjacent short rib 43, and by a socket top cover in the form of a rectangular plate 44 bridging the ribs 41 and 43. The socket extends circumferentially over between ⅕ and ½, and preferably between ¼ and ⅓ of the width of the tile 18.

As shown more clearly in FIG. 5, the rib 40 is free to slide in the circumferential direction 46 within the socket. The socket top cover 44 is separated from the inner surface of the tile 18 by a gap slightly greater in the radial direction than the height of the rib 40 which it accommodates, so as to provide a sliding clearance 47 which is small enough to limit bending by virtue of the contact between the rib 40 and the top cover 44 and the tile skin 18. Thus the top cover and the tile provide radial reaction forces acting on the rib 40 to prevent or at least to limit the bending motion, i.e. the ability of adjacent tiles to bend along their adjacent edge. A total clearance of say 2% of the socket engagement length would permit an angular misalignment of 1.145° tile to tile. The actual angle tolerable may be determined by experiment. The lower limit of the clearance would be determined by the incidence of binding.

Figure 1:
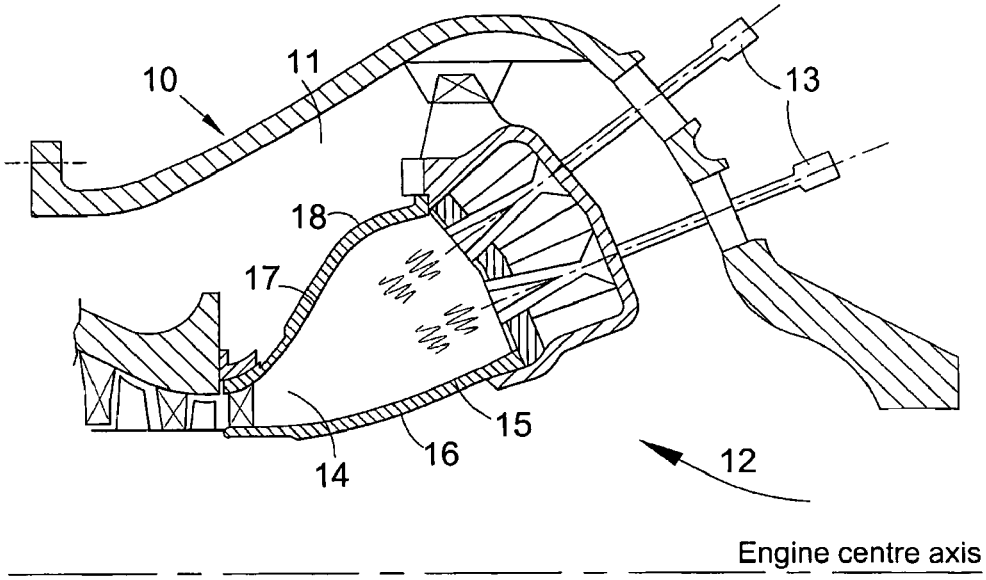
Fig.1 Prior Art
FIG. 1, to which reference has already been made, is an axial section through part of a gas turbine engine according to the prior art.
Figure 2:
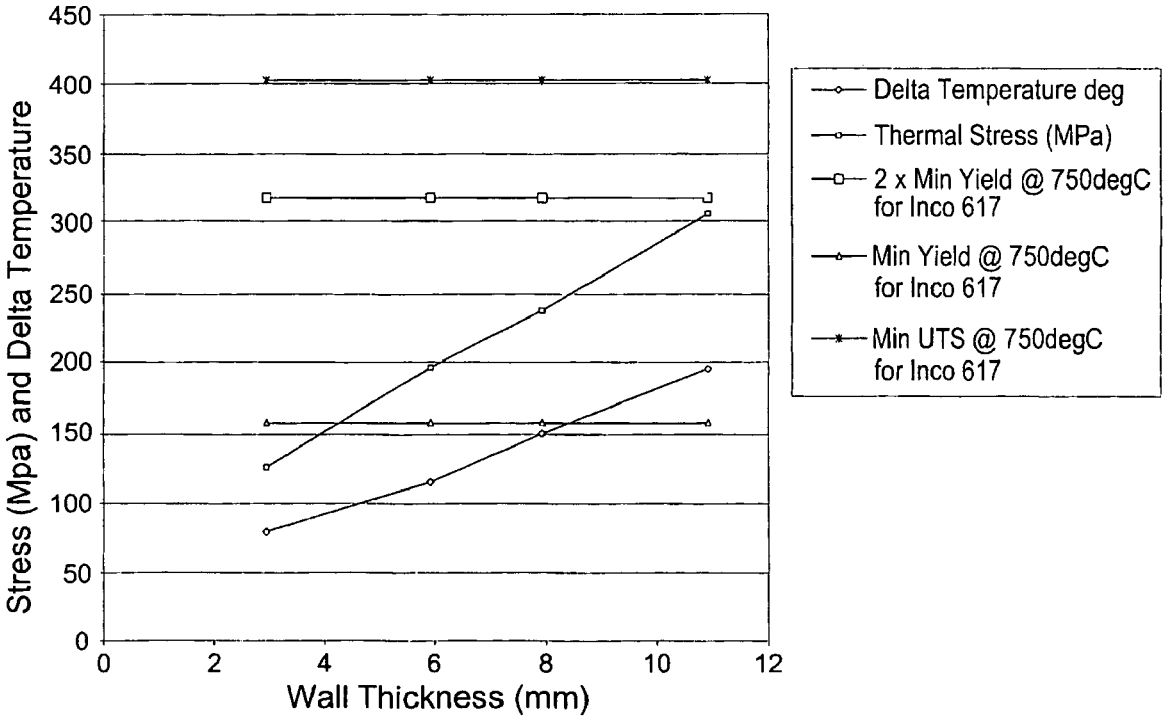
Fig.2 Prior Art
FIG. 2, to which reference has already been made, is a table illustrating temperature gradient and thermal stress in various different liner shells of a combustion chamber of a gas turbine engine engine according to the prior art as shown in FIG. 1.
Figure 3A:
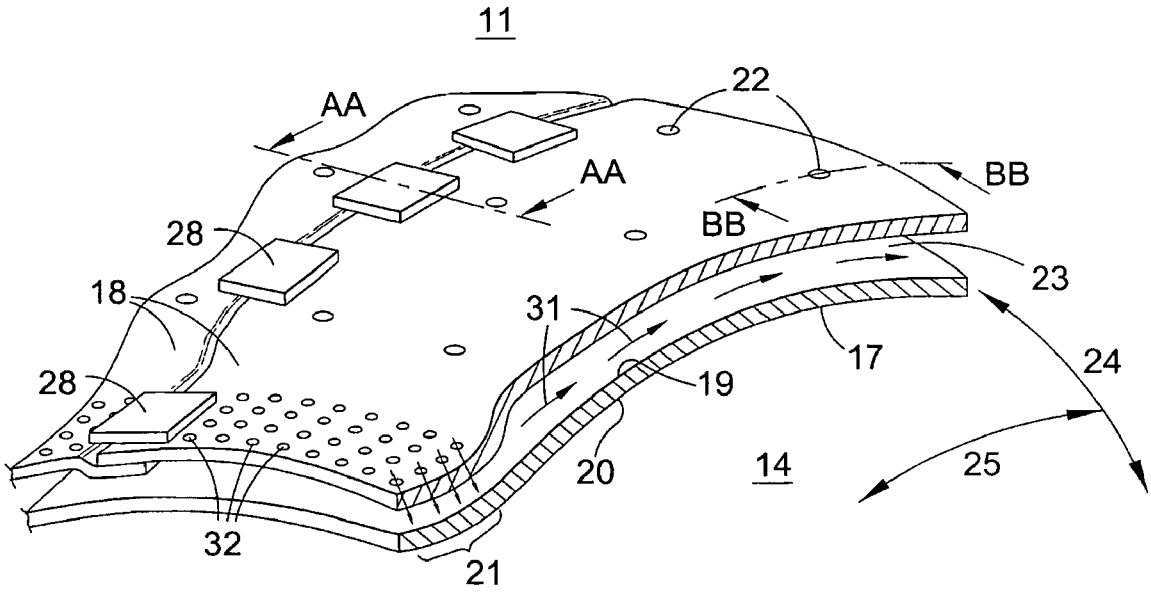
Fig.3a Prior Art
FIGS. 3*a* to 3*c*, to which reference has already been made, illustrate an existing structure engine according to the prior art for an exo-skeleton tile structure overlying a liner shell of the type shown in FIG. 1, FIG. 3*a* being a partial perspective view showing parts of two adjacent tiles.
Figure 3B:
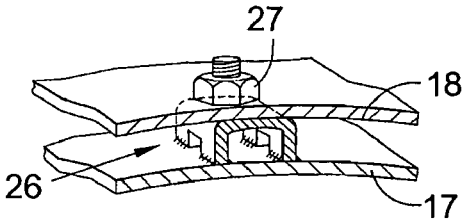
Fig.3b Prior Art
Figure 3C:
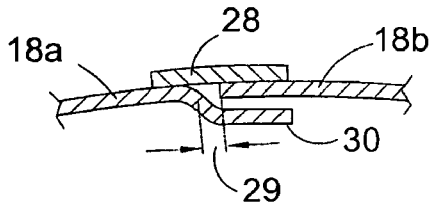
Fig.3c Prior Art

In other respects, each tile 18 has the features of the conventional tile shown in FIG. 3, including the apertures 22 for receiving studs welded to the liner shell 17. The multiplicity of small apertures 32 for impingement flow is illustrated in FIG. 4.

Figure 6:
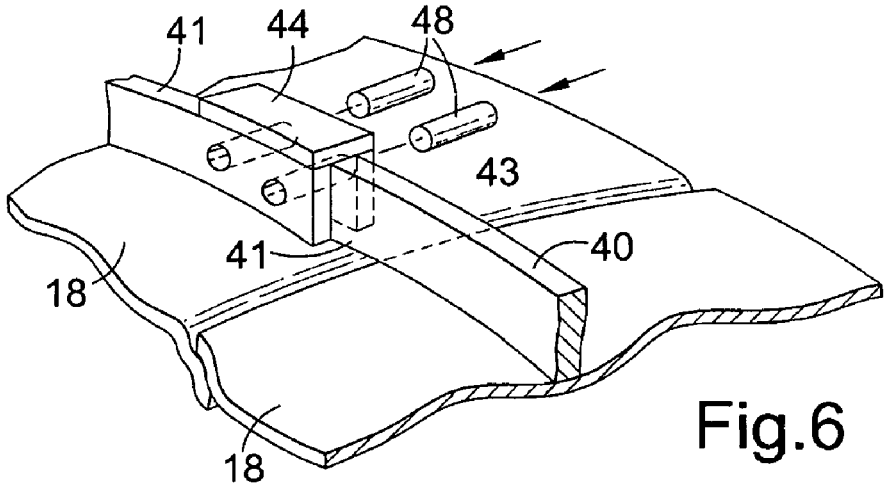
FIG. 6 is a partial perspective view of two inter-engaging tiles, showing the use of pins for temporarily locking the ribs of adjacent tiles together.

As shown in FIG. 6, the sockets and the projecting portions 41 of the ribs 40 are formed with apertures for accommodating the pair of pins 48 which are assembled by pushing them axially through the apertures to lock the tile joints. This provides extra rigidity during handling pre-assembly, but the pins must be removed after assembly and before use, to allow for thermal circumferential expansion at the joints (the extra rigidity during handling being provided to protect the TBC coating system from excessive handling damage caused by deflections to the inner shell liner prior to installation).

The exo-skeleton tile structure is assembled over the liner shell by locating each successive tile 18 over the studs and inter-engaging the edges of adjacent tiles, with the projecting portions of the ribs sliding into the sockets. The nuts and washers are then secured over the studs. This process may be facilitated by leaving the sockets open at the top until after assembly, i.e. by brazing or welding the top covers 44 once the tiles are in place.

The tuning of resonant vibration modes is possible by optimization of the stiffening ribs 41 and 45, and damping is facilitated by friction in the sliding joints between the ribs and the sockets.

Use of the exo-skeleton tile structure according to the invention facilitates the use of still thinner liner shell structures in gas turbines, and this leads to consequential improvements in the thermal low cycle fatigue (LCF) component life. It further allows for enhanced tuning of problematic vibration modes by optimising rib stiffness, and allows for mechanical damping by energy absorption due to friction in the sliding cavities of the sockets.

The wear coatings applied to the tiles (or to the liner shells or both) including the ribs are selected in accordance with the outcome of tribology tests, and one example of a suitable coating is Stellite 6 (Trade Mark) coating.

The present invention has been described above purely by way of example, and modifications can be made within the scope of the invention as claimed. The invention also consists in any individual features described or implicit herein or shown or implicit in the drawings or any combination of any such features or any generalisation of any such features or combination, which extends to equivalents thereof. Thus, the breadth and scope of the present invention should not be limited by any of the above-described exemplary embodiments. Each feature disclosed in the specification, including the claims and drawings, may be replaced by alternative features serving the same, equivalent or similar purposes, unless expressly stated otherwise.

Any discussion of the prior art throughout the specification is not an admission that such prior art is widely known or forms part of the common general knowledge in the field.

Unless the context clearly requires otherwise, throughout the description and the claims, the words "comprise", "comprising", and the like, are to be construed in an inclusive as opposed to an exclusive or exhaustive sense; that is to say, in the sense of "including, but not limited to".

I claim:

1. A combustion liner tile for securement to an underlying generally annular combustion liner shell, the tile comprising:

a generally part-annular tile body having an outer surface facing away from the liner shell and first and second circumferentially opposed edges, the first edge having a first radius;

an edge strip at the second edge of the tile body, the edge strip having a second radius different from the first radius, the edge strip of the tile being operative for overlapping a first edge of an adjacent tile to form a generally continuous annular surface between adjacent tiles during circumferential thermal expansion and contraction in use;

at least one external main rib fastened to, and extending circumferentially across and substantially normally away from, the outer surface of the tile body, the at least one external main rib having a projecting end region that projects beyond one of the edges of the tile body, and a socket end region that is circumferentially spaced away from the other of the edges of the tile body, the socket end region of the at least one external main rib of the tile being operative for receiving a projecting end region of an external main rib of the adjacent tile in circumferential sliding engagement to resist relative circumferential bending of the adjacent tiles about their overlapping edges; and wherein the socket end region includes an external short rib fastened to the outer surface of the tile body, the short rib having a length shorter than the at least one main external rib and extending parallel thereto, and a top cover bridging the short rib and the at least one main external rib.

2. The tile according to claim 1, and a multiplicity of apertures for impingement flow of gas through the tile body and into a gap between the tile and the liner shell in use.

3. The tile according to claim 1, in which the socket end region extends circumferentially over between ⅕ and ½ of a width of the tile body.

4. The tile according to claim 1, in which the socket end region extends circumferentially over between ¼ and ⅓ of a width of the tile body.

5. The tile according to claim 1, in which the at least one main external rib is of rectangular section and has a longer side that extends normally from the outer surface of the tile body.

6. The tile according to claim 1, comprising at least two external main ribs axially spaced apart and extending in mutual parallelism.

7. The tile according to claim 1, and at least one axially-extending stiffening rib fastened to the outer surface of the tile body and axially crossing the at least one external main rib.

8. The tile according to claim 6, and at least one axially-extending stiffening rib fastened to the outer surface of the tile body and axially crossing the at least two external main ribs.

9. The tile according to claim 1, and apertures through the tile body for receiving studs projecting radially from the liner shell.

10. The tile according to claim 1, in which the tile body is formed of high strength weldable metal alloy capable of withstanding 500° C.

11. The tile according to claim 10, in which the alloy is an indium cobalt alloy.

12. The tile according to claim 1, in which the at least one external main rib is brazed or tungsten inert gas (TIG) type welded to the tile body to transmit shear loading in use.

13. The tile according to claim 1, in which the tile body has a curvature which varies smoothly along a major axis of the liner shell.

14. The tile according to claim 1, and means for temporarily fixing together the socket end region of the at least one external main rib of the tile and the projecting end region of the adjacent tile to resist circumferential movement during assembly.

15. The tile according to claim 14, in which the fixing means comprise pins received in holes axially formed through the socket end region and the projecting end region.

16. The tile according to claim 1, in which the tile body subtends circumferentially an angle of from 5 degrees to 15 degrees.

17. The tile according to claim 16, in which the tile body subtends circumferentially an angle of from 10 degrees to 15 degrees.

18. A generally annular exo-skeleton tile structure for securement to an underlying annular combustion liner shell to facilitate cooling of the liner shell by axial gas flow along a gap therebetween, comprising:

a plurality of circumferentially adjacent part-annular tiles linked together edgewise, each tile including a generally part-annular tile body having an outer surface facing away from the liner shell and first and second circumferentially opposed edges, the first edge of a respective tile having a first radius, an edge strip at the second edge of the tile body of the respective tile and having a second radius different from the first radius, the edge strip of each tile overlapping the first edge of an adjacent tile to form a generally continuous annular surface between the adjacent tiles during circumferential thermal expansion and contraction in use; and at least one external main rib fastened to, and extending circumferentially across and substantially normally away from, the outer surface of each tile body, the at least one external main rib having a projecting end region that projects beyond one of the edges of the tile body, and a socket end region that is circumferentially spaced away from the other of the edges of the tile body, the socket end region of the at least one external main rib of each tile receiving the projecting end region of the external main rib of the adjacent tile in circumferential sliding engagement to resist relative circumferential bending of the adjacent tiles about their overlapping edges.

19. The exo-skeleton tile structure according to claim 18, in which each tile body has a radius which varies smoothly along a major axis of the tile structure, and in which the exo-skeleton tile structure has a radius which varies smoothly along the major axis.

* * * * *